US006019627A

United States Patent [19]

Embo et al.

[11] Patent Number: 6,019,627

[45] Date of Patent: Feb. 1, 2000

[54] PLUG CONNECTOR HAVING A CONNECTING CABLE

[75] Inventors: Georges Embo, Langemark, Belgium; Heribert Rester, Steinberg, Germany; Tom Debrouwere, Wevelgem; Christophe Vermaete, Meulebeke, both of Belgium

[73] Assignee: Siemens Aktiengesellschaft, Munich, Germany

[21] Appl. No.: 09/221,783

[22] Filed: Dec. 28, 1998

Related U.S. Application Data

[63] Continuation of application No. PCT/DE97/01308, Jun. 24, 1997.

[51] Int. Cl.[7] ..... H01R 4/24

[52] U.S. Cl. ..... 439/412; 439/417; 439/405

[58] Field of Search ..... 439/412, 417, 439/395, 404, 405, 409, 411, 431

[56] References Cited

U.S. PATENT DOCUMENTS

| | | | |
|---|---|---|---|
| 3,816,818 | 6/1974 | Meier | 439/412 |
| 4,153,326 | 5/1979 | Frantz et al. | 439/404 |
| 4,217,022 | 8/1980 | Carré | 439/404 |
| 4,274,696 | 6/1981 | Long et al. | 439/395 |
| 4,917,629 | 4/1990 | Matsuzaki et al. | 439/405 |
| 4,988,311 | 1/1991 | Tanzola | 439/404 |
| 5,078,616 | 1/1992 | Nemcovsky | 439/404 |
| 5,122,079 | 6/1992 | Locati | 439/417 |
| 5,238,424 | 8/1993 | Vindum | 439/425 |
| 5,295,857 | 3/1994 | Toly | 439/395 |

FOREIGN PATENT DOCUMENTS

| | | |
|---|---|---|
| 0 255 358 A2 | 2/1988 | European Pat. Off. . |
| 0 700 126 A1 | 3/1996 | European Pat. Off. . |
| 36 11 390 C1 | 3/1987 | Germany . |
| 8713046 | 3/1989 | Germany . |
| 195 16 240 A1 | 11/1995 | Germany . |
| 44 39 786 A1 | 5/1996 | Germany . |

*Primary Examiner*—Paula Bradley
*Assistant Examiner*—Tho D. Ta
*Attorney, Agent, or Firm*—Herbert L. Lerner; Laurence A. Greenberg

[57] ABSTRACT

A plug connector having a two-part housing formed of a lower part and a cover. The cover is used as a pressure clamping plate during connection of the two housing parts by screws and presses insulated individual conductors of a connecting cable, which have previously been inserted into guides disposed in the lower part of the housing into insulation displacement connection (IDC) contacts. The IDC contacts that are fixed in the lower part between the guides, and firmly clamps the connecting cable in a cable entry of the housing.

11 Claims, 7 Drawing Sheets

PLUG CONNECTOR HAVING A CONNECTING CABLE

CROSS-REFERENCE TO RELATED APPLICATION

This is a continuation of copending International Application PCT/DE97/01308, filed Jun. 24, 1997, which designated the United States.

BACKGROUND OF THE INVENTION

FIELD OF THE INVENTION

The invention relates to a plug connector having a two-part housing formed of a cover and a housing lower part. The housing lower part has a plug body containing plug contacts and the cover has an underneath side with grooves formed therein. A connecting cable having insulated individual conductors is connected to the plug contacts via insulation displacement connection (IDC) technology. At least one group of IDC contacts each having an insulation-piercing terminal slot formed therein and fixed in the housing lower part transversely with respect to the insulated individual conductors and the grooves. The grooves run in an insertion direction facing the housing lower part in a region which corresponds roughly to a region with the at least one group of IDC contacts.

German Utility Model DE-U 87 13 046 discloses a plug connector which has a two-part housing including a housing lower part and a cover. A metallic plug body, to which a shielded round cable has already been connected, is inserted into the housing lower part. Furthermore, shielding plates are inserted into the housing parts and, when the housing parts are joined together, they are electrically conducively connected, by making contact with the metallic plug body and to the shield of the cable. Furthermore, the cover is constructed with pins on its underneath side and the housing lower part has recesses for receiving the pins. The pins and recesses are configured such that, once the cover has been fitted onto the housing lower part, the two housing parts are firmly connected to one another and the housing is closed. In order to make it possible to fasten the entire plug detachably on a mating plug, two screws are provided which are inserted into holes, which run parallel to the insertion direction, in the side walls of the housing lower part. The known plug connector provides no information about the connection of the individual conductors of the shielded cable to the plug pins of the metallic plug body.

European Patent Application EP 0 255 358 A2 as well as Published, Non-Prosecuted German Patent Application DE 195 16 240 A1 disclose further plug connectors which likewise have a housing lower part having a plug body and a connected cable and have a cover which is fastened to the housing lower part by screws. The individual conductors in the cable in the case of the known plug connectors are connected to the contact pins in the plug body before the housing parts are connected. The conductors are connected either by soldering or using the Insulation Displacement Connection (IDC) technique or by contacts that displace the conductor insulation. Individual conductor connections are formed without having to strip the insulation is admittedly provided in the case of both known plug connectors, but this connection also has to be made before the housing parts are connected, so that two separate connection and assembly process steps are required. The process of connecting the individual conductors normally requires the application of a certain amount of force, possibly by a die or via plastic parts and a press. Thus, in both cases, force has to be applied using additional aids during the connection process.

U.S. Pat. No. 5,122,079 discloses a connector for a ribbon cable which has a large number of individual conductors. The connector includes a housing and a cover which can be connected to the housing. Two groups of IDC contacts are provided on the side of the housing facing the cover, disposed transversely with respect to the incoming individual conductors, and are each constructed with an insulation-piercing terminal slot. The underneath side of the cover, facing the housing, is provided in a region that corresponds roughly to the region with the IDC contacts with grooves. The grooves run in the insertion direction of the individual conductors which, when the cover is being fitted onto two pillars in the housing, are pressed into insulation-piercing terminal slots in the IDC contacts and make contact with the IDC contacts.

SUMMARY OF THE INVENTION

It is accordingly an object of the invention to provide a plug connector having a connecting cable which overcomes the above-mentioned disadvantages of the prior art devices of this general type, in which further simplification of a connection of an insulated individual conductor or of a plurality of insulated individual conductors in a connecting cable is accomplished without having to strip the insulation.

With the foregoing and other objects in view there is provided, in accordance with the invention, a plug connector cable, including: a two-part housing formed of a housing lower part and a cover connected to the housing lower part, the housing lower part having a plug body containing plug contacts and the cover has an underneath side with grooves formed therein; a connecting cable has insulated individual conductors connected to the plug contacts via insulation displacement connection (IDC) technology; at least one group of IDC contacts each having an insulation-piercing terminal slot formed therein and fixed in the housing lower part transversely with respect to the insulated individual conductors, the grooves formed in the cover run in an insertion direction of the insulated individual conductors and face the housing lower part in a region corresponding roughly to a region with the at least on group of IDC contacts, the grooves match a shape of the insulated individual conductors; fork-shaped guides are disposed in the housing lower part on both sides of the at least one group of IDC contacts in the insertion direction and project above the at least one group of IDC contacts for receiving the insulated individual conductors; screws connect the cover to the housing lower part; and the insulated individual conductors are pressed into the at least one group of IDC contacts and make contact with the at least one group of IDC contacts as the screws are tightened during the connection of the cover to the housing lower part.

The object is achieved according to the invention by the following features:

a) fork-shaped guides, which project above the group of IDC contacts, are provided for the individual conductors and are disposed in the insertion direction of the individual conductors on both sides of the group of IDC contacts, b) the cover can be connected to the housing lower part by screws, and c) the individual conductors are pressed into the IDC contacts and make contact with the IDC contacts when the cover and the housing lower part are connected to each other by the tightening of the connecting screws.

In the case of such a plug connector, the IDC contacts and the guides for the individual conductors in the connecting cable are disposed in the housing lower part. The guides are disposed and configured such that the individual conductors come to rest, during manual insertion, above the IDC contacts in a guided position which is prepared for the IDC contacts to be pressed in. The other housing part, namely the cover which forms the upper housing part, which must in any case be connected to the lower housing part to form a closed housing, is at the same time used in the case of the plug connector according to the invention as a pressure part and as a clamping plate. The underneath side of the cover facing the housing lower part is configured in an appropriate manner such that it can press the individual conductors into the IDC contacts. The major advantage of the plug connector according to the invention is that the individual conductors in a connecting cable are simultaneously pressed into the IDC contacts and make contact with the IDC contacts by the cover during the fastening of the cover to the housing lower part, which has to be carried out anyway, by screwing in and tightening the screws. In this case, it is particularly advantageous that neither a special connection process nor additional pressing, stripping or other preparation tools are required to make contact with the individual conductors and the process of connecting the individual conductors in the connecting cable is carried out simultaneously and unavoidably during the process of fitting the cover to the housing lower part.

In accordance with an added feature of the invention, the housing lower part has a plurality of recesses formed therein and the cover on the underneath side has a plurality of projections facing and engaging in the plurality of recesses in the housing lower part for aligning the cover onto the housing lower part.

In accordance with an additional feature of the invention, the cover on the underneath side has a plurality of mutually parallel reinforcing ribs facing toward the housing lower part, the grooves receiving the insulated individual conductors running between the plurality of mutually parallel reinforcing ribs.

In accordance with another feature of the invention, the connecting cable has an outer sheath and an insulation layer enclosing each of the insulated individual conductors; and the at least one group of IDC contacts include contact elements each having two fork limbs defining the insulation-piercing terminal slot between the two forked limbs, the two fork limbs at least one of penetrating into the insulation layer and cutting tangentially into the outer sheath of the insulated individual conductors.

In order to insert a connecting cable into the two-part housing of the plug connector, it is expedient if the cover and the housing lower part are provided on one side of the housing with a cable entry or a part of a cable entry.

In accordance with a further added feature of the invention, the cable entry is defined by a cable entry wall having at least one of wedge-shaped spikes and blade-like webs for relieving tension on the connecting cable enclosed in the cable entry.

In the case of a plug connector according to the invention, it is particularly advantageous if at least two screws are provided in order to connect the cover and the housing lower part. One screw is disposed in the region of the cable entry and in the insertion direction of the individual conductors, in front of a guide and the IDC contacts for the individual conductors, and the other screw is disposed downstream of the region. In this way, only one process is required to fasten the cover to the housing lower part, to clamp the connecting cable firmly in the cable entry or between the two parts of the cable entry, and to press the individual conductors of the connecting cable into the IDC contacts and to make contact with the IDC contact.

In accordance with a further additional feature of the invention, the screws are at least two screws for connecting the cover to the housing lower part, one of the at least two screws is disposed in a region of the cable entry along the insertion direction of the individual conductors in front of the guide and the at least one group of IDC contacts, and another of the at least two screws is disposed after the region.

For connecting a shielded cable and a corresponding ground connection, it is advantageous in the case of the plug connector according to the invention if a ground plate consisting of a stamped and bent part is inserted into the housing lower part and is configured such that it has side arms which project from a base plate and extend into the cable entry and can be conducively connected via the base plate to a metallic region of the plug body.

In accordance with another added feature of the invention, the ground plate has spring tongues in a region of the base plate and the spring tongues are connectable to the plug body.

In accordance with a concomitant feature of the invention, the base plate of the ground plate has vertical perforated lugs formed therein.

Other features which are considered as characteristic for the invention are set forth in the appended claims.

Although the invention is illustrated and described herein as embodied in a plug connector having a connecting cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
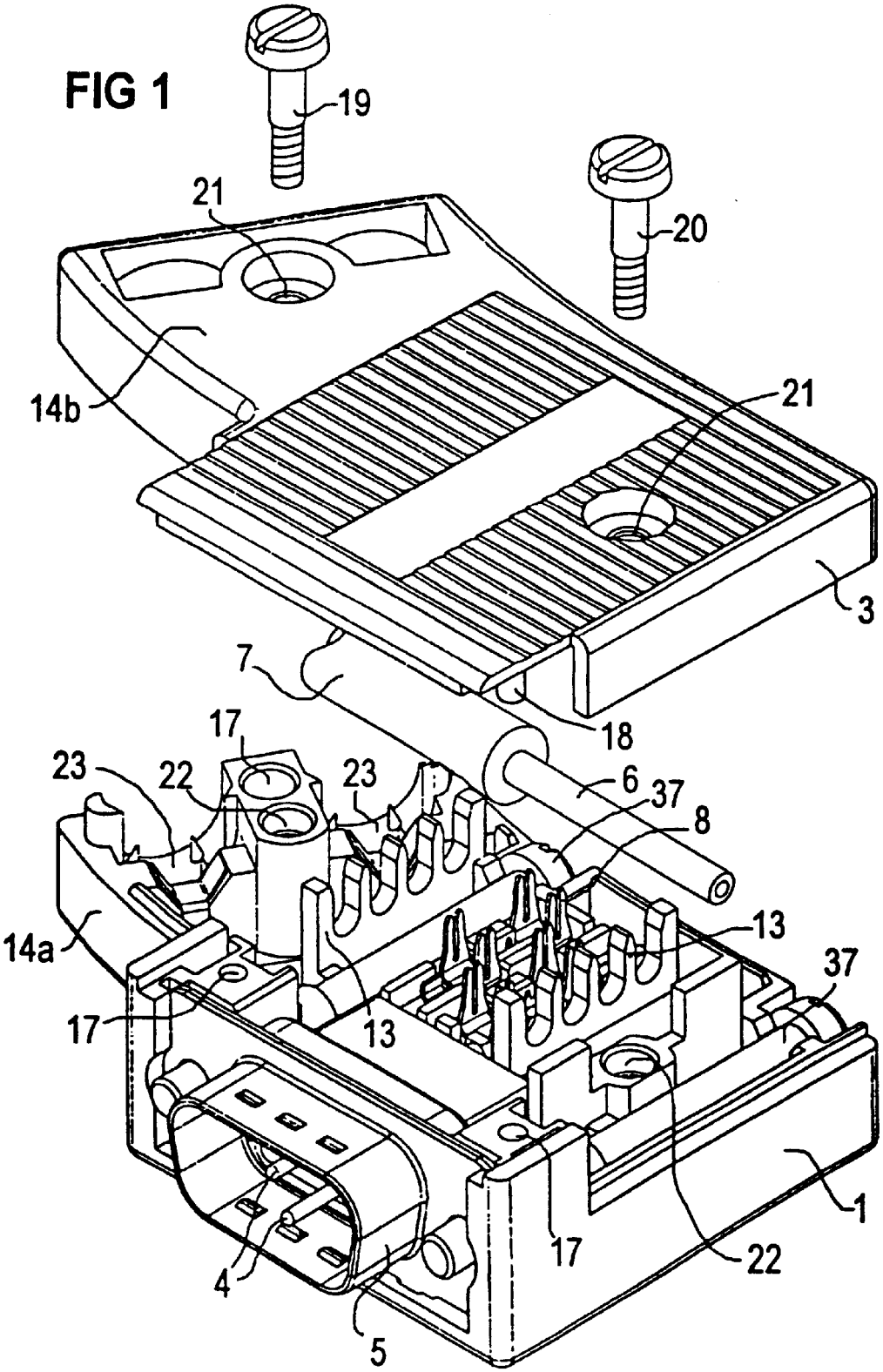
FIG. 1 is an exploded, perspective view of a housing of a plug connector according to the invention.

In all the figures of the drawing, sub-features and integral parts that correspond to one another bear the same reference symbol in each case. Referring now to the figures of the drawing in detail and first, particularly, to FIG. 1 thereof, there is shown a plug connector having a two-part housing.

The two-part housing is composed of a housing lower part 1, which is configured, for example, as a base half-shell, and a cover 3 as a housing upper part, which can be connected by screws 19, 20 to the housing lower part 1.

Figure 3:
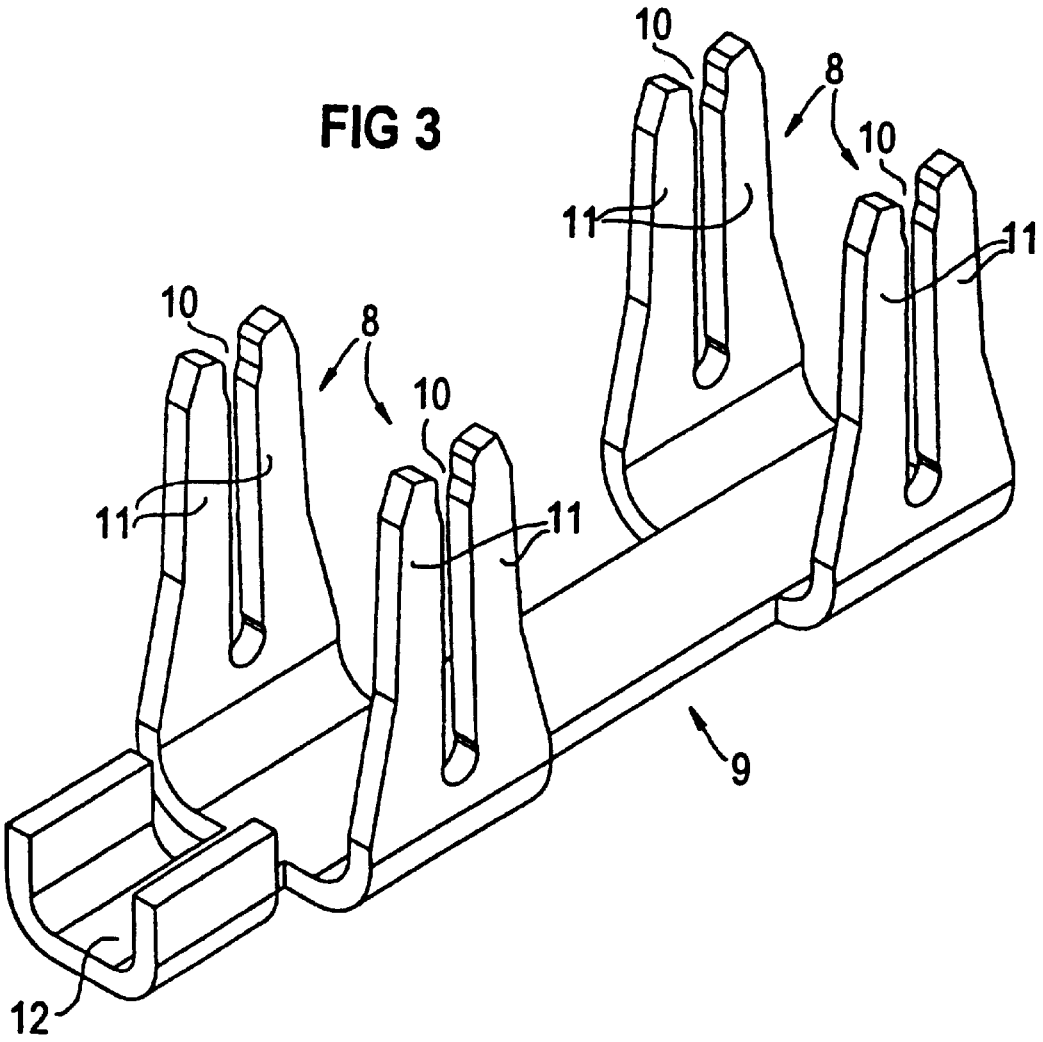
FIG. 3 is a perspective view of a group of IDC contacts.

The two housing parts 1, 3 are produced, for example, as a plastic injection-molded part. The housing lower part 1 is essentially used to accommodate a plug body 5 which contains plug contacts 4 and has a plug face (which is constructed to be conductive) and/or a metallic shield. The plug body 5 also connects to at least one insulated individual conductor 6 of a connecting cable 7 which can be inserted into the housing 1, 3. The insulated individual conductors 6 make contact using IDC technology without having to strip the insulation, and are connected to the plug contacts 4 in the plug body 5. To this end, at least one group of IDC contacts 8 is fixed in the housing lower part 1, transversely with respect to the incoming individual conductors 6. Such a group of IDC contacts is illustrated in FIG. 3. The group is produced from a sheet-metal stamped and bent part 9 that has two pairs of IDC contacts 8 that are in this case disposed aligned with respect to one another.

Figure 4:
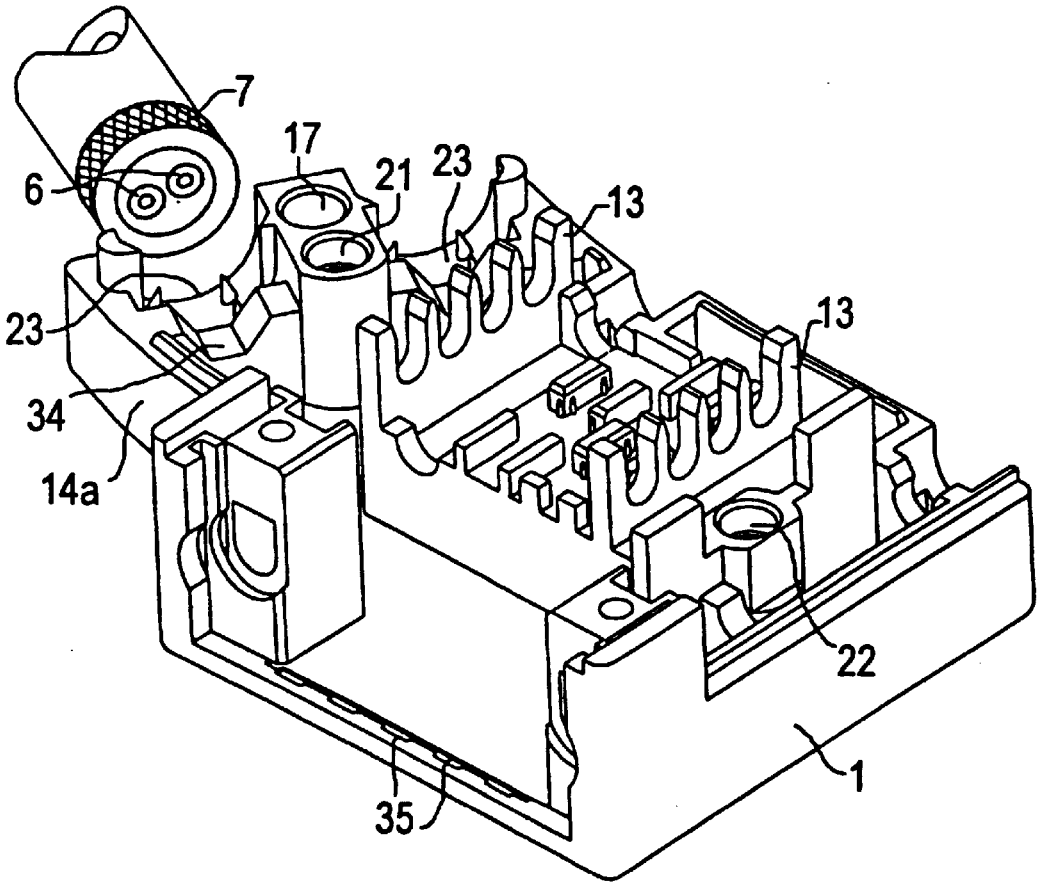
FIG. 4 is a perspective view of a housing lower part of the housing.

The IDC contacts 8 include contact elements having two fork limbs 11 that form an insulation-piercing terminal slot 10 between them. The fork limbs 11 are configured such that they penetrate into the insulation layer of the individual conductor 6 and/or cut tangentially into the outer sheath of the individual conductor 6. In consequence, the fork limbs 11 are configured in such a manner that it is possible that they make contact with solid and braided conductors having thin or relatively thick insulation. In the case of relatively thick insulation, the fork limbs 11 cut into the insulation instead of, as is normal, cutting through it. This type of IDC connection requires less force to be applied, reduces the tendency of the fork limbs 11 to spread apart and produces better fixing since the fork limbs 11 of the IDC contacts 8 are still surrounded by the insulation material of the individual conductors. At one end, the illustrated sheet-metal stamped and bent part 9 is constructed with a connecting piece 12 which has a U-shaped contact and can be connected to and make contact with the plug contacts 4 of the plug body 5 for example by soldering or, advantageously, without soldering, for example by crimping. As FIGS. 1, 4 and 7 clearly show, fork-shaped guides 13 for the individual conductors 6 are provided on the housing lower part 1 in the insertion direction of the individual conductors 6 on both sides of the groups of IDC contacts 8. The guides 13 project above the IDC contacts 8 so that, when the individual conductors 6 are inserted manually, they come to rest above the IDC contacts 8. In addition, like the cover 3 as well, the housing lower part 1 is also configured with a part 14*a* or 14*b* of a cable entry on one side of the housing. The cable entry is in this case configured, for example by two roughly parallel troughs 23, such that two cables can be inserted into the housing. As FIG. 1, for example, clearly shows, the plug body 5 is provided on a housing side which is adjacent to the cable entry and runs transversely with respect to it, so that it represents here an angled plug connector, for example of SUB-D configuration.

Figure 2:
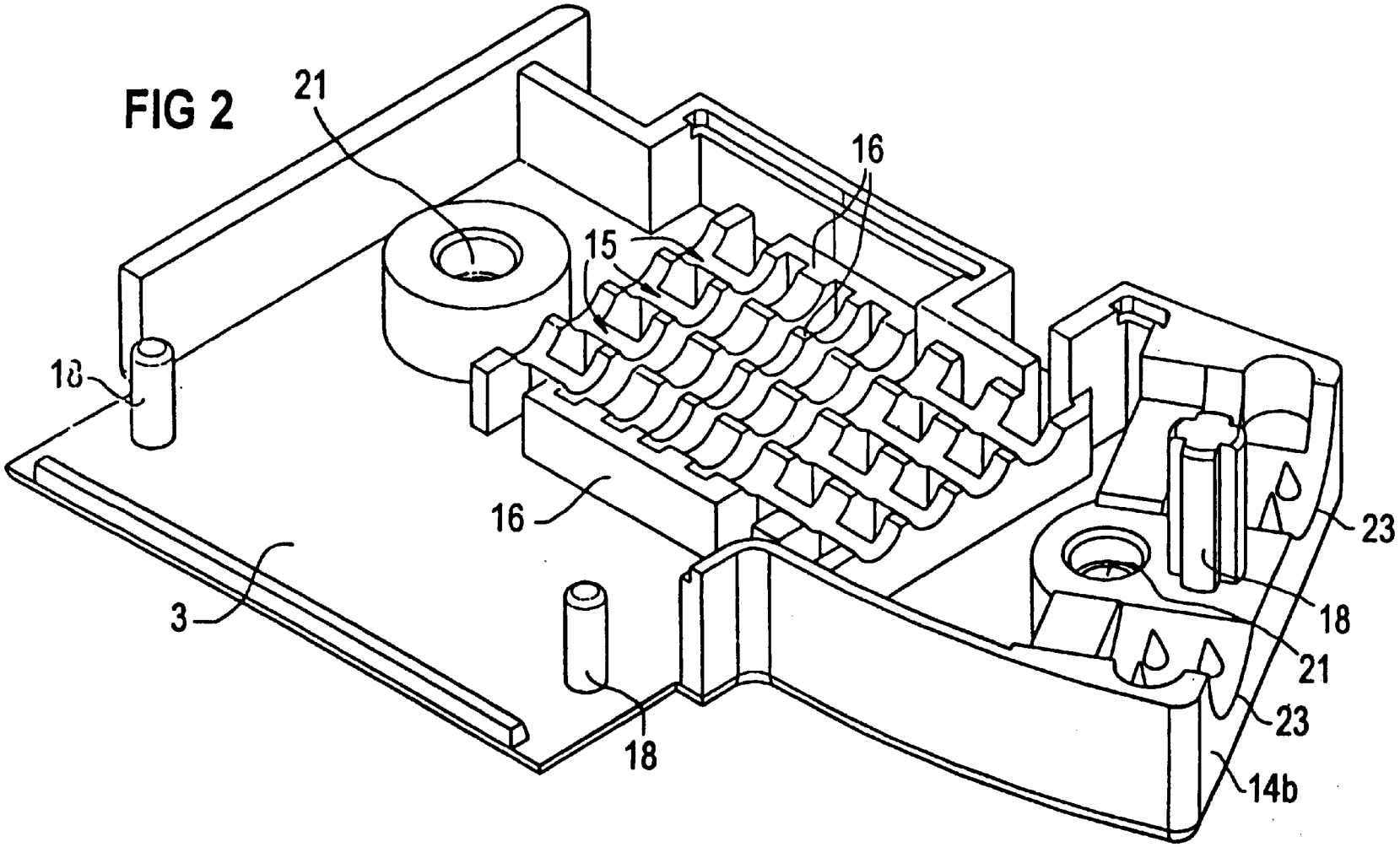
FIG. 2 is a perspective view of an underneath side of a housing part that is used as a cover.

The upper housing part, namely the cover 3 of the housing, is at the same time used as a cover for the housing lower part and as a pressure clamping plate both during the process of connecting the individual conductors 6 using the IDC technique and during the introduction and fixing of the connecting cable. To this end, as already mentioned, the cover 3 is constructed with the part 14*b* of the cable entry as well as, on its underneath facing the housing lower part 1, as can be clearly seen from FIG. 2, and in an opposite region corresponding to the region with the IDC contacts 8 and the guides 13 in the housing lower part, is provided with grooves 15 for the individual conductors. The grooves 15 run in the insertion direction of the individual conductors 6 and are matched to the shape of the individual conductors 6. The grooves 15 are formed, for example, as dome-shaped recesses between a plurality of reinforcing ribs 16, which run parallel to one another, on the underneath of the cover.

Figure 7:
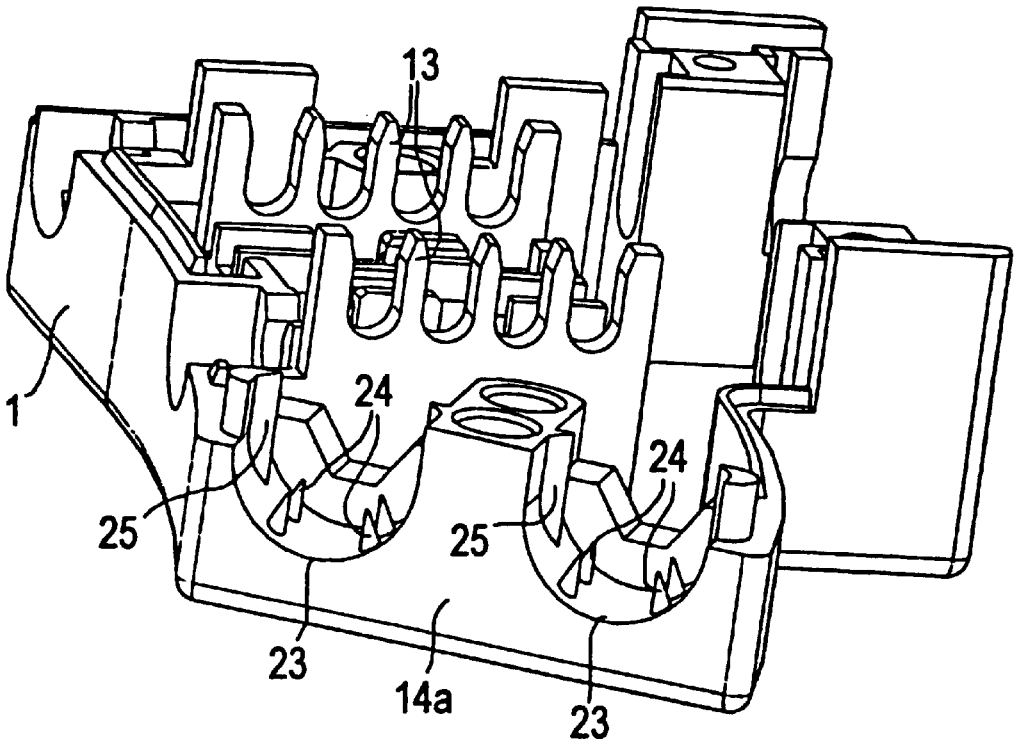
FIG. 7 is a perspective view of the lower part of the housing having a specially configured cable entry.

In order to connect the two housing parts 1,3, the cover 3 is placed on the housing lower part 1 and is aligned on the housing lower part 1 by a plurality of pin-like projections 18 which engage in recesses 17 in the housing lower part 1. The connection between the cover 3 and the housing lower part 1 is produced by at least two screws 19, 20, for example self-tapping screws. One screw 19 is disposed in the region of the cable entry and, seen in the insertion direction of the individual conductors 6, in front of the guide 13 and the IDC contacts 8, and the other screw 20 is disposed after this region, and is screwed into holes 22 in the housing lower part 1, through holes 21 in the cover 3. At the same time that the cover 3 and the housing lower part 1 are being connected, the individual conductors 6 are pressed into the IDC contacts 8 and make contact with the IDC contacts, by the underneath of the cover 3, as a result of the screws 19, 20 being screwed in and tightened. Furthermore, the connecting cable 7 is in this way at the same time firmly clamped in the cable entry. In order to reliably relieve the tension on the cable connection in the process, the troughs 23 in the cable entry parts 14*a*, 14*b* are configured with wedge-shaped spikes 24 and/or blade-like webs 25 (FIG. 7). The spikes 24 additionally prevent the connecting cable from twisting in the plug connector.

Figure 5:
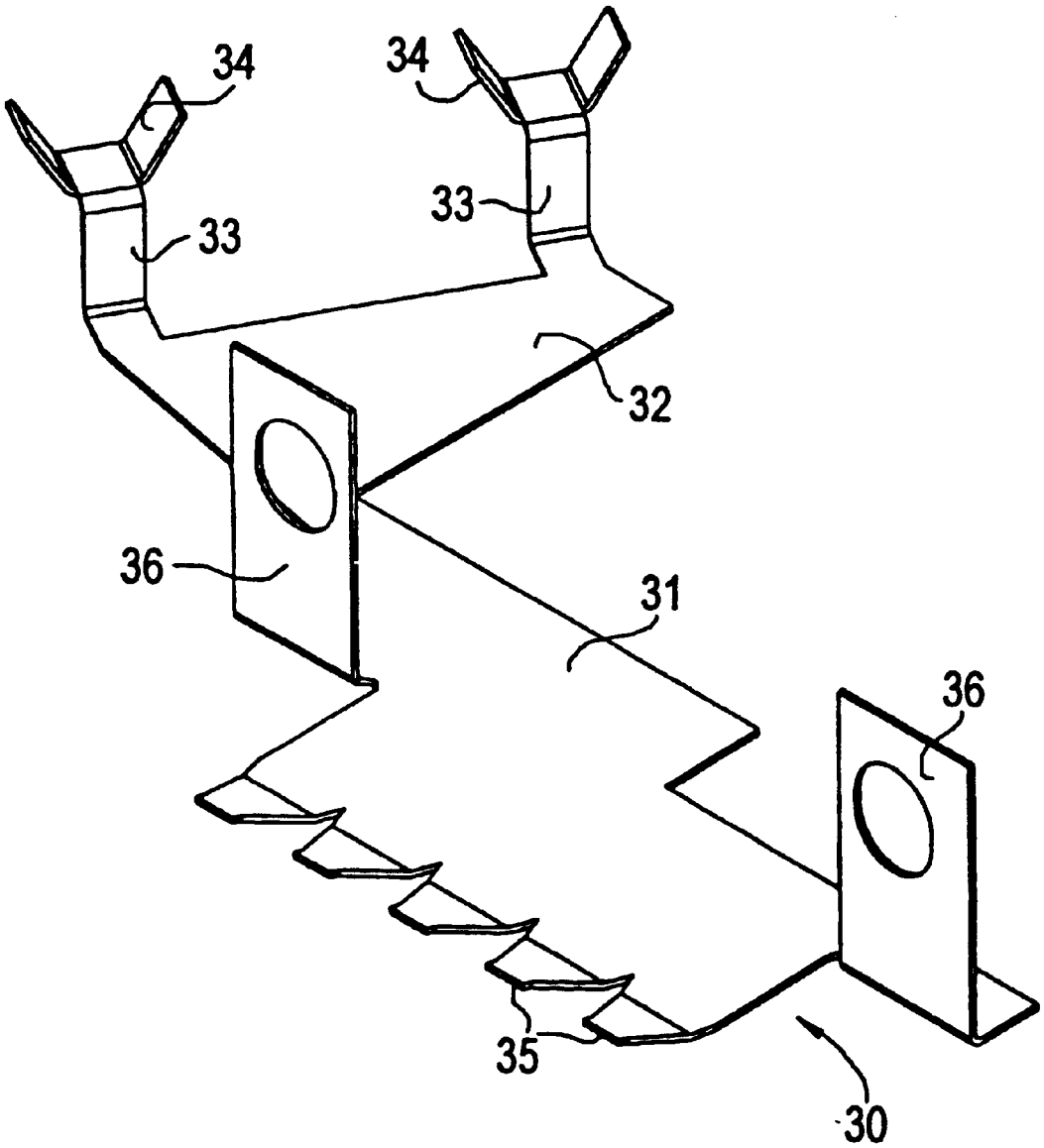
FIG. 5 is a perspective view of a ground plate.
Figure 6:
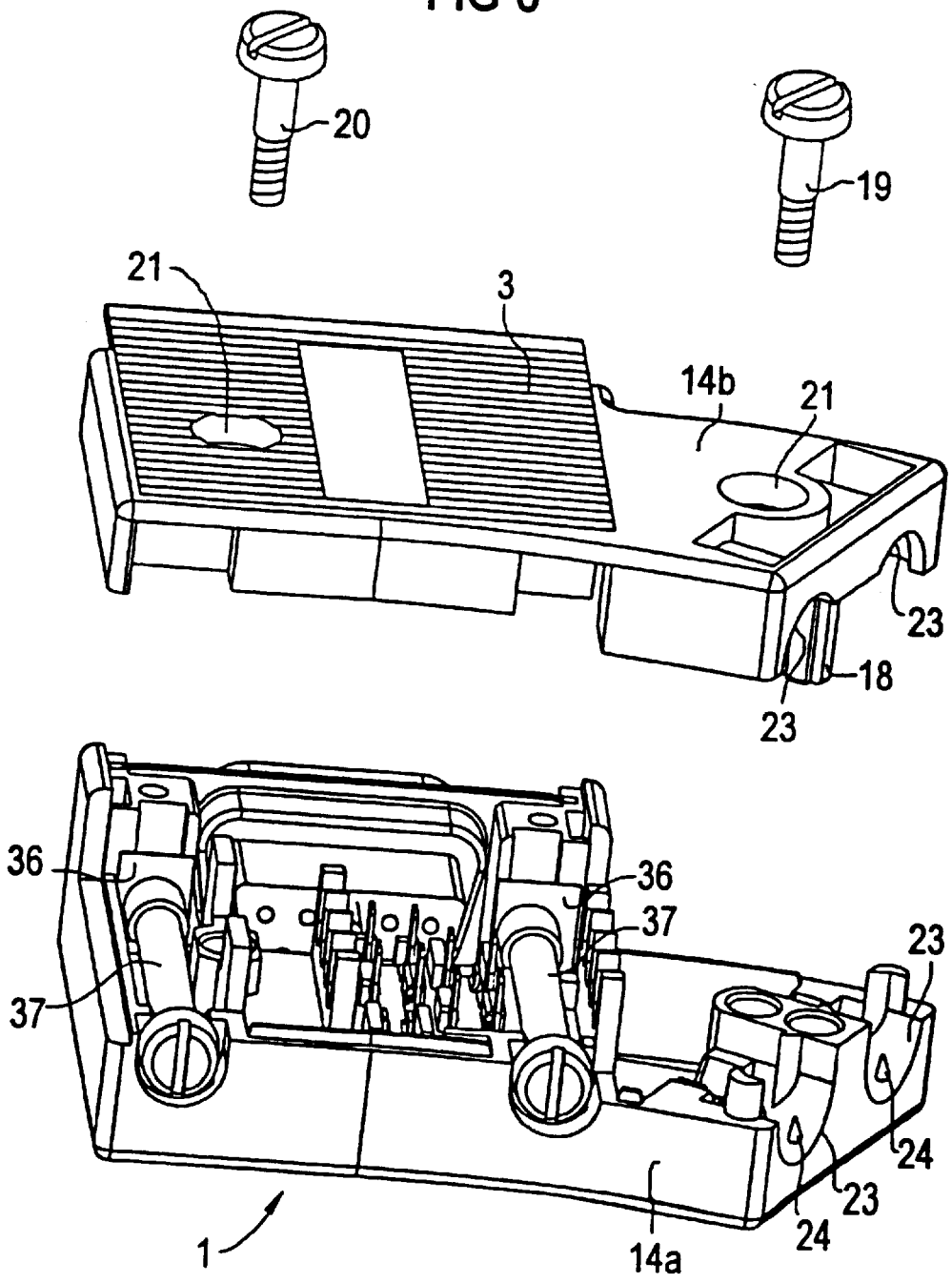
FIG. 6 is an exploded, perspective view of the housing of the plug connector.

The illustrated plug connector is also configured to be suitable for the connection of shielded cables. For this purpose, it is necessary to continue the ground line on to the mating connector or to an equipment chassis. A ground plate 30 (FIGS. 5 and 6) consisting of a stamped and bent part is thus provided as a ground conductor and is inserted into the housing lower part 1. The ground plate 30 includes a base plate 31 having a side extension 32 that extends toward the cable entry. From the side extension 32, two arms 33 project upward, at the end of which an approximately U-shaped or V-shaped lug 34 is bent out, which is used as a contact for the cable shield. The base plate 31 is configured with spring tongues 35 on one longitudinal edge. The spring tongues 35 are bent out toward the plug body 5 and rest conducively against its metallic region. Furthermore, the base plate 31 is also configured to have side, vertical lugs 36, which are perforated such that, during connection to a mating connector, the lugs 36 make electrical contact with the waisted screws 37 which are pushed through and can be seen in FIGS. 1 and 6, and ground conduction to the mating plug or the equipment chassis takes place via these waisted screws.

We claim:

1. A plug connector, comprising:

a two-part housing including a housing lower part and a cover connected to said housing lower part, said housing lower part having a plug body containing plug contacts and said cover having an underneath side with grooves formed therein;

a connecting cable having insulated individual conductors connected to said plug contacts via insulation displacement connection (IDC) technology;

at least one group of IDC contacts connected to said plug contacts, said at least one group of IDC contacts each having an insulation-piercing terminal slot formed therein and said at least one group of IDC contacts fixed in said housing lower part transversely with respect to said insulated individual conductors, said grooves running in an insertion direction of said insulated individual conductors and facing said housing lower part in a region corresponding roughly to a region with said at least on group of IDC contacts, said grooves matching a shape of said insulated individual conductors;

fork-shaped guides disposed in said housing lower part on both sides of said at least one group of IDC contacts in said insertion direction and projecting above said at least one group of IDC contacts for receiving said insulated individual conductors;

screws connecting said cover to said housing lower part; and said insulated individual conductors being pressed into said at least one group of IDC contacts and making contact with said at least one group of IDC contacts as said screws are tightened during a connection of said cover to said housing lower part.

2. The plug connector according to claim 1, wherein said housing lower part has a plurality of recesses formed therein and said cover on said underneath side having a plurality of projections facing and engaging in said plurality of recesses in said housing lower part for aligning said cover onto said housing lower part.

3. The plug connector according to claim 1, wherein said cover on said underneath side has a plurality of mutually parallel reinforcing ribs facing toward said housing lower part, said grooves receiving said insulated individual conductors running between said plurality of mutually parallel reinforcing ribs.

4. The plug connector according to claim 1, wherein:

said connecting cable has an outer sheath and an insulation layer enclosing each of said insulated individual conductors; and said at least one group of IDC contacts include contact elements each having two fork limbs defining said insulation-piercing terminal slot between said two forked limbs, said two fork limbs at least one of penetrating into said insulation layer and cutting tangentially into said outer sheath of said insulated individual conductors.

5. The plug connector according to claim 1, wherein said two-part housing has a side with a cable entry formed therein.

6. The plug connector according to claim 5, wherein said cable entry is formed of a first part formed in said cover and a second part formed in said housing lower part.

7. The plug connector according to claim 5, wherein said cable entry is defined by a cable entry wall having at least one of wedge-shaped spikes and blade-like webs for relieving tension on said connecting cable enclosed in said cable entry.

8. The plug connector according to claim 5, wherein said screws are at least two screws for connecting said cover to said housing lower part, one of said at least two screws is disposed in a region of said cable entry along said insertion direction of said insulated individual conductors in front of said guide and said at least one group of IDC contacts, and another of said at least two screws is disposed after said region.

9. The plug connector according to claim 5, wherein said plug body has a metallic region, and including a ground plate formed as a stamped and bent part disposed in said housing lower part, said ground plate having a base plate and side arms projecting from said base plate and extending into said cable entry and conducively connectable via said base plate to said metallic region of said plug body.

10. The plug connector according to claim 9, wherein said ground plate has spring tongues in a region of said base plate and said spring tongues are connectable to said plug body.

11. The plug connector according to claim 9, wherein said base plate of said ground plate has vertical perforated lugs formed therein.

* * * * *